US010807137B2

(12) United States Patent
Otsuka et al.

(10) Patent No.: US 10,807,137 B2
(45) Date of Patent: Oct. 20, 2020

(54) PRODUCTION METHOD FOR PRODUCING A PRESS-FORMED PRODUCT

(71) Applicant: NIPPON STEEL & SUMITOMO METAL CORPORATION, Tokyo (JP)

(72) Inventors: Kenichiro Otsuka, Tokai (JP); Yoshiaki Nakazawa, Takarazuka (JP); Ryuichi Nishimura, Kimitsu (JP); Masahiro Saito, Tokai (JP)

(73) Assignee: NIPPON STEEL CORPORATION, Tokyo (JP)

( * ) Notice: Subject to any disclaimer, the term of this patent is extended or adjusted under 35 U.S.C. 154(b) by 477 days.

(21) Appl. No.: 15/544,054

(22) PCT Filed: Jan. 25, 2016

(86) PCT No.: PCT/JP2016/000338
§ 371 (c)(1),
(2) Date: Jul. 17, 2017

(87) PCT Pub. No.: WO2016/121358
PCT Pub. Date: Aug. 4, 2016

(65) Prior Publication Data

US 2018/0009017 A1 Jan. 11, 2018

(30) Foreign Application Priority Data

Jan. 26, 2015 (JP) ..... 2015-012269

(51) Int. Cl.
*B21D 5/01* (2006.01)
*B21D 22/26* (2006.01)
(Continued)

(52) U.S. Cl.
CPC ..... *B21D 5/01* (2013.01); *B21D 5/0209* (2013.01); *B21D 22/26* (2013.01); *B21D 24/005* (2013.01); *B21D 53/88* (2013.01)

(58) Field of Classification Search
CPC . B21D 5/01; B21D 5/006; B21D 5/02; B21D 22/26; B21D 5/0272
See application file for complete search history.

(56) References Cited

U.S. PATENT DOCUMENTS

2012/0279273 A1* 11/2012 Tsuchiya ..... B21D 22/02 72/358
2014/0182349 A1 7/2014 Yonemura et al.

FOREIGN PATENT DOCUMENTS

JP 2004-181502 7/2004
JP 2010-172912 8/2010
(Continued)

*Primary Examiner* — Debra M Sullivan
(74) *Attorney, Agent, or Firm* — Clark & Brody LP

(57) ABSTRACT

A method for producing a press-formed product that includes a pair of flat sections and a bend section that connects the flat sections, in which a bending radius of the bend section is $R_2$ and an interior angle formed by the pair of flat sections is $\theta_2$, includes the steps bellow. In the first forming step, an intermediate formed product including a bend section in which a bending radius is $R_1$ and an interior angle is $\theta_1$ is formed. In the second forming step, a portion of a bend section of the intermediate formed product is formed into the bend section of the press-formed product. $R_1$, $\theta_1$, $R_2$ and $\theta_2$ satisfy the conditions of Formulae (1) to (3) below:

$$1.05<A_1/A_2 \quad (1);$$

$$1.0<R_1/R_2 \quad (2);$$

$$A_1/A_2<6.0/(R_1/R_2) \quad (3),$$

where, $A_1$, $A_2$ represents the supplementary angle of the interior angle $\theta_1$, $\theta_2$, respectively.

4 Claims, 14 Drawing Sheets

(51) Int. Cl.

| | |
|---|---|
| ***B21D 5/02*** | (2006.01) |
| *B21D 24/00* | (2006.01) |
| *B21D 53/88* | (2006.01) |

(56) References Cited

FOREIGN PATENT DOCUMENTS

| | | |
|---|---|---|
| JP | 2012-115868 | 6/2012 |
| JP | 2012-232329 | 11/2012 |
| JP | 5610073 | 10/2014 |

* cited by examiner

PRIOR ART

PRIOR ART

PRODUCTION METHOD FOR PRODUCING A PRESS-FORMED PRODUCT

TECHNICAL FIELD

The present invention relates to a press-formed product for use in automobiles, in various vehicles other than automobiles, in general machinery, and in ships and vessels and the like, and more particularly relates to a press-formed product having a bend section, as well as a method and an equipment line for producing the press-formed product.

BACKGROUND ART

Press-formed products having a bend section are used, for example, in frame members of an automobile body (for example: cross members, side members, side sills, pillars and the like), and are used in various components of an automobile (for example: door impact beams, toe-control links, suspension arms and the like). The aforementioned press-formed products are obtained by bending a steel plate as a starting material using a press. In recent years, there is a demand to improve fuel consumption in order to contribute to global environmental protection, and there is also a demand for enhanced safety at the time of a collision. Therefore, press-formed products are being increasingly made with thinner walls using high strength steel plates. However, there is a contrary relation between enhancing the strength of the starting material and the workability (particularly the bendability) of the starting material.

FIG. 1A and FIG. 1B are cross-sectional diagrams that illustrate an overview of a conventional common bending method. FIG. 1A illustrates a situation when performing bending, and FIG. 1B illustrates a press-formed product 2 that is produced after undergoing the bending illustrated in FIG. 1A. In the conventional bending method, a bend section 5 in the press-formed product 2 is formed by press working in a single step. Specifically, as shown in FIG. 1A, a steel plate 1 is bent using a punch 3 and a die 4. By this means, as shown in FIG. 1B, the press-formed product 2 having the bend section 5 is formed.

In general, the bendability of the steel plate 1 is evaluated based on a limit R/t. Here, "R" represents a minimum bending radius with which bending can be performed without the occurrence of cracking, and "t" represents the thickness of the steel plate 1. In recent years, high strength steel plates having a tensile strength of 980 MPa or more and a small degree of elongation have begun to be used as the starting material for the aforementioned frame members. Further, high strength steel plates having a tensile strength of 590 MPa or more are being used as the starting material for suspension components (for example, suspension arms). In short, as the strength of the steel plate 1 increases, there is a tendency for the limit R/t to also increase. Consequently, if the bending radius of the bend section 5 of the press-formed product 2 is designed to be a small radius, the steel plate 1 will crack. On the other hand, if the bending radius of the bend section 5 of the press-formed product 2 is designed to be a large radius, the rigidity of the frame member or suspension component will decrease and the impact energy absorption performance thereof will decline. Accordingly, there is a strong need for a processing method that can decrease the limit R/t when producing the press-formed product 2 having the bend section 5 from a high strength steel plate.

FIG. 2A to FIG. 2C are cross-sectional diagrams illustrating an overview of a bending method disclosed in Japanese Patent Application Publication No. 2010-172912 (Patent Literature 1). Among these drawings, FIG. 2A illustrates a situation when performing processing in a first step and FIG. 2B illustrates a situation when performing processing in a second step. FIG. 2C illustrates a press-formed product 7 that is produced as a result of undergoing the bending illustrated in FIG. 2A and FIG. 2B.

In the bending method disclosed in Patent Literature 1, a bend section 8 of the press-formed product 7 formed by press working that is divided into two steps. Specifically, as shown in FIG. 2A, in the press working in the first step, a steel plate 6 is bent using a punch 9 and a die 10. The punch 9 and the die 10 impart a shape having a bending radius $R_1$ that is larger than a bending radius $R_2$ of the bend section 8 of the press-formed product 7 to the steel plate 6. By this means, as shown in FIG. 2B, an intermediate formed product 12 having a bend section 11 with a bending radius $R_1$ is formed.

In the press working in the second step, as shown in FIG. 2B, the intermediate formed product 12 is subjected to processing using a punch 13 and a die 14. The punch 13 and the die 14 impart a shape having the bending radius $R_2$ of the bend section 8 of the press-formed product 7 to the intermediate formed product 12. By this means, the press-formed product 7 illustrated in FIG. 2C is formed.

According to the bending method disclosed in Patent Literature 1, cracking does not occur in the press working in the first step because the bending radius $R_1$ is large. In addition, in the press working in the second step, tensile strain that arises in the outer surface of the bend section 8 is reduced, and the occurrence of cracking can be suppressed.

In the bending method disclosed in Patent Literature 1, a front end angle $\theta_2$ of the punch 13 used in the second step is the same as a front end angle $\theta_1$ of the punch 9 used in the first step. In other words, the interior angle of the bend section 8 of the press-formed product 7 is the same as the interior angle of the bend section 11 of the intermediate formed product 12.

CITATION LIST

Patent Literature

Patent Literature 1: Japanese Patent Application Publication No. 2010-172912

SUMMARY OF INVENTION

Technical Problem

Patent Literature 1 discloses that the limit R/t can be made 0 when producing a press-formed product having a bend section using a stainless steel plate that has high tensile strength of 889 MPa and in which the elongation is a high value of 59%. However, even when using the bending method disclosed in Patent Literature 1, for example, in a case of using a metal plate having high tensile strength and a small degree of elongation such as in a high strength steel plate, there is a risk that cracking will occur at the bend section. Accordingly, there is a need to enable reliable lowering of the limit R/t.

One objective of the present invention is to provide a press-formed product in which tensile strain in an outer surface of the bend section is small and cracking is suppressed, even though the product has a bend section with a small bending radius and a tensile strength of 590 MPa or more. Another objective of the present invention is to provide a production method and a production equipment line that can produce the aforementioned press-formed product.

Solution to Problem

A press-formed product according to one embodiment of the present invention is made from a metal plate having a tensile strength of 590 MPa or more, and includes a pair of flat sections and a bend section connecting the pair of flat sections. In the press-formed product, at a cross section, a plate thickness increases as a distance from a vicinity of a top part of the bend section increases, the plate thickness decreases as a distance from a vicinity of an end of the bend section increases, and thereafter the plate thickness increases again, and beyond a position separated by a distance corresponding to 1.5 times an original plate thickness from a position of an end of the bend section, the plate thickness becomes the original plate thickness.

In the aforementioned press-formed product, a ratio "$t_2/t_1$" between an average value $t_2$ of a plate thickness in an area from the position of the end of the bend section to the position separated therefrom by the distance corresponding to 1.5 times the original plate thickness, and a plate thickness $t_1$ at the top part of the bend section is preferably less than 1.01.

In a case where the aforementioned press-formed product includes a top plate part, two vertical wall parts, and a ridge line part connecting the top plate part and the respective vertical wall parts, preferably the top plate part and the vertical wall part constitute the flat section, and the ridge line part constitutes the bend section.

In a case where the aforementioned press-formed product includes a top plate part, two vertical wall parts, an upper-side ridge line part connecting the top plate part and the respective vertical wall parts, two flange parts, and a lower-side ridge line part connecting the respective vertical wall parts and the respective flange parts, preferably the top plate part and the vertical wall part constitute the flat section, and the upper-side ridge line part constitutes the bend section, and/or the vertical wall part and the flange part constitute the flat section, and the lower-side ridge line part constitutes the bend section.

Preferably the aforementioned press-formed product is made from a steel plate having a tensile strength or 1180 MPa or more. The tensile strength may be 780 MPa or more, or may be 980 MPa or more.

A production method for producing a press-formed product according to one embodiment of the present invention is a method for producing a press-formed product including a pair of flat sections, and a bend section connecting the pair of flat sections, and in which a bending radius of the bend section is represented by $R_2$ and an interior angle formed by the pair of flat sections is represented by $\theta_2$. The production method includes a starting material preparation step, a first forming step and a second forming step. In the starting material preparation step, a metal plate having a tensile strength or 590 MPa or more is prepared. In the first forming step, the metal plate is subjected to press working using a die assembly to form an intermediate formed product having a bend section with a bending radius of $R_1$ (mm) and an interior angle of $\theta_1$ (°) at a portion corresponding to the bend section of the press-formed product. In the second forming step, the intermediate formed product is subjected to press working using a die assembly to form the press-formed product having a bend section with a bending radius of $R_2$ (mm) and an interior angle of $\theta_2$ (°) at a portion of the bend section of the intermediate formed product. The bending radius $R_1$ and the interior angle $\theta_1$ of the intermediate formed product and the bending radius $R_2$ and the interior angle $\theta_2$ of the press-formed product satisfy conditions of Formulae (1) to (3) hereunder.

$$1.05<A_1/A_2 \quad (1)$$

$$1.0<R_1/R_2 \quad (2)$$

$$A_1A_2<6.0/(R_1/R_2) \quad (3)$$

In the above Formulae, $A_1$ (°) is a supplementary angle of the interior angle $\theta_1$ of the intermediate formed product, which is represented by Formula (A) hereunder, and $A_2$ (°) is a supplementary angle of the interior angle $\theta_2$ of the press-formed product, which is represented by Formula (B) hereunder.

$$A_1=180-\theta_1 \quad (A)$$

$$A_2=180-\theta_2 \quad (B)$$

In the aforementioned production method, preferably the bending radius $R_1$ and the interior angle $\theta_1$ of the intermediate formed product and the bending radius $R_2$ and the interior angle $\theta_2$ of the press-formed product satisfy conditions of Formulae (1), (4) and (5) hereunder.

$$1.05<A_1/A_2 \quad (1)$$

$$1.5<R_1/R_2 \quad (4)$$

$$A_1/A_2<3.5/(R_1/R_2) \quad (5)$$

In the aforementioned production method, preferably a punch and a die are used as the die assembly in the first forming step, and a punch and a die are used as the die assembly in the second forming step. In this case, in the second forming step, preferably, when performing press working, the intermediate formed product is restrained and positioned by a die pad provided in the die and an inner pad provided in the punch.

A production equipment line for producing a press-formed product according to one embodiment of the present invention is an equipment line for producing a press-formed product including a pair of flat sections, and a bend section connecting the pair of flat sections, and in which a bending radius of the bend section is represented by $R_2$ and an interior angle formed by the pair of flat sections is represented by $\theta_2$. The production equipment line includes a first press apparatus and a second press apparatus. The first press apparatus includes a punch and a die for forming an intermediate formed product having a bend section with a bending radius of $R_1$ (mm) and an interior angle of $\theta_1$ (°) at a portion corresponding to the bend section of the press-formed product. The second press apparatus includes a punch and a die for forming the press-formed product having a bend section with a bending radius of $R_2$ (mm) and an interior angle of $\theta_2$ (°) at a portion of the bend section of the intermediate formed product. The bending radius $R_1$ and the interior angle $\theta_1$ of the intermediate formed product and the bending radius $R_2$ and the interior angle $\theta_2$ of the press-formed product satisfy the conditions of the aforementioned Formulae (1) to (3).

In the aforementioned production equipment line, preferably the bending radius $R_1$ and the interior angle $\theta_1$ of the intermediate formed product and the bending radius $R_2$ and the interior angle $\theta_2$ of the press-formed product satisfy the conditions of the aforementioned Formulae (1), (4) and (5).

In the aforementioned production equipment line, preferably the second press apparatus further includes a die pad provided in the die and an inner pad provided in the punch, and when performing press working, the intermediate formed product is restrained and positioned by the die pad and the inner pad.

Advantageous Effects of Invention

The press-formed product of the present invention has a bend section with a small bending radius and has a tensile strength of 590 MPa or more, and tensile strain in an outer surface of the bend section of the press-formed product is small and cracking is suppressed. The production method and the production equipment line of the present invention can produce such a press-formed product.

DESCRIPTION OF EMBODIMENTS

Figure 1A:
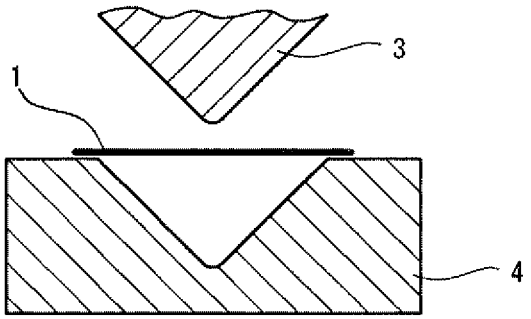
FIG. 1A is a cross-sectional diagram illustrating an overview of a conventional common bending method, which illustrates a situation when performing bending.
Figure 1B:
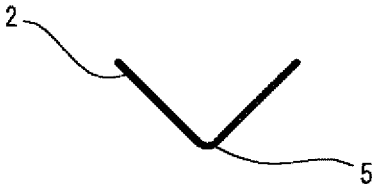
PRIOR ART FIG. 1B
FIG. 1B illustrates a press-formed product that is produced as a result of undergoing the bending illustrated in FIG. 1A.

The present inventors conducted repeated intensive studies to solve the above described problem, and as a result obtained the findings described in (a) to (c) hereunder.

(a) The press-formed product having a pair of flat sections and a bend section connecting the pair of flat sections will now be discussed. In the press-formed product, a bending radius at the bend section is $R_2$ (mm), and an interior angle formed by the pair of flat sections is $\theta_2$ (°). A high strength steel plate having a tensile strength of 590 MPa or more is adopted as a starting material, and the press-formed product is produced by press working that is divided into two steps. In press working in a first step, using a punch and a die as a die assembly, an intermediate formed product is formed that has a bend section with a bending radius of $R_1$ (mm) and an interior angle of $\theta_1$ (°) at a portion corresponding to the bend section of the press-formed product in the steel plate. In press working in a second step, using a punch and a die as a die assembly, the press-formed product is formed in which the bend section of the intermediate formed product is formed into a bend section with a bending radius of $R_2$ (mm) and an interior angle of $\theta_2$ (°).

In this case, to suppress the occurrence of cracking at the bend section, it is sufficient that tensile strain that occurs in the outer surface (hereunder, also referred to as "surface layer strain") of the bend section is small. A perimeter ratio "$L_1/L_2$" between a perimeter $L_1$ (mm) of the bend section formed in the first step and a perimeter $L_2$ (mm) of the bend section formed in the second step is a factor involved in determining the size of the surface layer strain that occurs in the bend section. The perimeters $L_1$ and $L_2$ of the bend section are lengths in the circumferential direction at a cross section of the bend section, and are represented by the following Formulae (i) and (ii).

$$L_1=\pi\times R_1\times(180-\theta_1)/180 \quad \text{(i)}$$

$$L_2=\pi\times R_2\times(180-\theta_2)/180 \quad \text{(ii)}$$

Further, the supplementary angle (that is, the exterior angle) $A_1$ (°) of the interior angle $\theta_1$ at the bend section that is formed in the first step is represented by the following Formula (A). The supplementary angle (that is, the exterior angle) $A_2$ (°) of the interior angle $\theta_2$ at the bend section that is formed in the second step is represented by the following Formula (B).

$$A_1=180-\theta_1 \quad \text{(A)}$$

$$A_2=180-\theta_2 \quad \text{(B)}$$

Based on the aforementioned Formulae (i), (ii), (A) and (B), the perimeter ratio "$L_1/L_2$" of the bend section is represented by the following Formula (iii).

$$L_1/L_2=(A_1\times R_1)/(A_2\times R_2) \quad \text{(iii)}$$

Accordingly, the bending radius $R_1$ and interior angle $\theta_1$ (exterior angle $A_1$) of the bend section of the intermediate formed product that is formed in the first step and the bending radius $R_2$ and interior angle $\theta_2$ (exterior angle $A_2$) of the bend section of the press-formed product that is formed in the second step are mutually involved in determining the size of surface layer strain that arises in the bend section.

If the aforementioned bending radius $R_1$ and interior angle $\theta_1$ (exterior angle $A_1$) and the aforementioned bending radius $R_2$ and interior angle $\theta_2$ (exterior angle $A_2$) satisfy the conditions of the following Formulae (1) to (3), an occurrence region of surface layer strain that occurs in the bend section expands as a result of performing the press working in the first step and the press working in the second step. Consequently, the surface layer strain in the bend section of the press-formed product decreases. By this means, even when a steel plate having a tensile strength of 590 MPa or more is used as a starting material, the occurrence of cracking can be suppressed and a press-formed product having a bend section with a smaller bending radius can be produced. More preferably, the aforementioned bending radius $R_1$ and interior angle $\theta_1$ (exterior angle $A_1$) and the aforementioned bending radius $R_2$ and interior angle $\theta_2$ (exterior angle $A_2$) satisfy the conditions of the following Formulae (1), (4) and (5).

$$1.05<A_1/A_2 \quad (1)$$

$$1.0<R_1/R_2 \quad (2)$$

$$A_1/A_2<6.0/(R_1/R_2) \quad (3)$$

$$1.5<R_1/R_2 \quad (4)$$

$$A_1/A_2<3.5/(R_1/R_2) \quad (5)$$

The above Formula (1) means that the exterior angle $A_1$ of the bend section formed in the first step is larger than the exterior angle $A_2$ of the bend section formed in the second step. In other words, the above Formula (1) means that, based on the above Formulae (A) and (B), the interior angle $\theta_1$ of the bend section formed in the first step is smaller than the interior angle $\theta_2$ of the bend section formed in the second step. The sizes of the respective interior angles $\theta_1$ and $\theta_2$ (exterior angles $A_1$ and $A_2$) are set in accordance with the design dimensions of the press-formed product. In practice, the sizes of the respective interior angles $\theta_1$ and $\theta_2$ are set within a range of 90° to 120°.

The above Formulae (2) and (4) mean that the bending radius $R_1$ of the bend section formed in the first step is larger than the bending radius $R_2$ of the bend section formed in the second step. The sizes of the respective bending radii $R_1$ and $R_2$ are set in accordance with the design dimensions of the press-formed product. Specifically, the bending radii $R_1$ and $R_2$ are set as follows.

A value of R/t for which there is a risk of cracking occurring at the bend section is from 0.5 to 3.0. Here, "R" represents the bending radius at the time of bending, and "t" represents the plate thickness of the metal plate on which the bending is executed. Normally, an average plate thickness of a flat section of a press-formed product, that is, the plate thickness of the metal plate that is the starting material is approximately 0.5 to 3.2 mm in the case of a sheet. In the case of a thick plate, the plate thickness is approximately 3.2 to 30 mm, and is more than 30 mm in some cases. In the present embodiment, with respect to bending of metal plates that have such various kinds of plate thicknesses, cases in which there is a risk of cracking occurring at a bend section are taken as the object of the embodiment.

That is, in a case where the plate thickness is, for example, 0.5 mm, the bending radius R of the bend section of the press-formed product, that is, the bending radius $R_2$ of the bend section formed in the second step, is approximately 0.25 to 1.5 mm. In this case, the bending radius $R_1$ of the bend section that is formed in the first step is approximately 0.26 to 8.2 mm, and preferably is approximately 0.38 to 5.2 mm. In a case where the plate thickness is, for example, 1.0 mm, the aforementioned bending radius $R_2$ is approximately 0.5 to 3.0 mm. In this case, the aforementioned bending radius $R_1$ is approximately 0.55 to 16.0 mm, and preferably is approximately 0.8 to 10.0 mm. In a case where the plate thickness is, for example, 3.2 mm, the aforementioned bending radius $R_2$ is approximately 1.5 to 9.0 mm. In this case, the aforementioned bending radius $R_1$ is approximately 1.6 to 49.0 mm, and preferably is approximately 2.3 to 31.0 mm. In a case where the plate thickness is, for example, 30 mm, the aforementioned bending radius $R_2$ is approximately 15 to 90 mm. In this case, the aforementioned bending radius $R_1$ is approximately 16 to 494 mm, and preferably is approximately 23 to 314 mm.

In particular, in a case where the conditions of the above Formulae (1) to (3) are satisfied, surface layer strain becomes less than in the case of the conventional bending method (in which press working is performed in only one step) illustrated in the above described FIG. 1A.

Figure 2A:
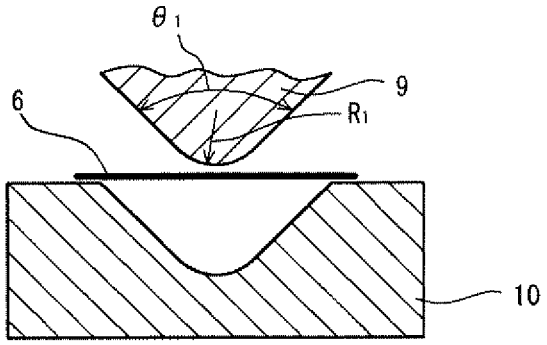
FIG. 2A is a cross-sectional diagram illustrating an overview of a bending method disclosed in Patent Literature 1, which illustrates a situation when performing processing in a first step.
Figure 2B:
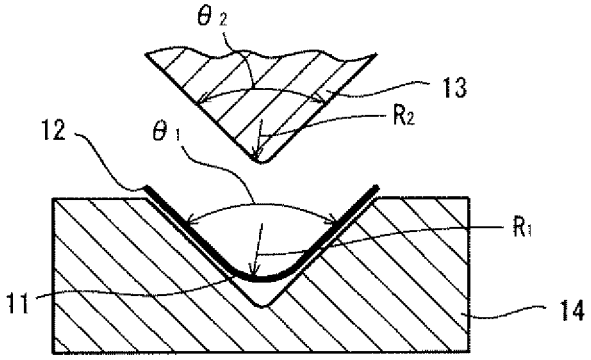
PRIOR ART FIG. 2B
FIG. 2B is a cross-sectional diagram illustrating an overview of the bending method disclosed in Patent Literature 1, which illustrates a situation when performing processing in a second step.
Figure 2C:
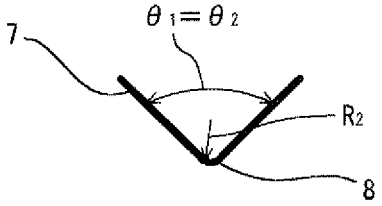
PRIOR ART FIG. 2C
FIG. 2C illustrates a press-formed product that is produced as a result of undergoing the bending illustrated in FIG. 2A and FIG. 2B.

In addition, in a case where the conditions of the above Formulae (1), (4) and (5) are satisfied, surface layer strain becomes less than in the case of the bending method disclosed in Patent Literature 1 (in which press working is divided into two steps) that is illustrated in the above described FIG. 2A and FIG. 2B.

In short, the bending radius $R_2$ of the bend section of the press-formed product is defined within a range of R/t at which there is a risk of cracking occurring at the bend section, in accordance with the plate thickness t of the metal plate. As described above, the range of R/t at which there is a risk of cracking occurring at the bend section is 0.5 to 3.0. In particular, if the metal plate has high ductility, an upper limit of R/t is 2.0. If the metal plate has even higher ductility, the upper limit of R/t is 1.0. Furthermore, the size of the bending radius $R_1$ of the bend section formed in the first step is defined in accordance with the conditions of the above Formulae (1) to (3) based on the aforementioned bending radius $R_2$, and more preferably is defined in accordance with the conditions of the above Formulae (1), (4) and (5). At such time, based on FIG. 16 that is described later, $R_1/R_2$ is preferably less than 5.5, and more preferably is less than 3.5.

(b) A press-formed product that is produced by the bending method described in the above (a) has a characteristic plate thickness distribution at the bend section and the vicinity thereof. Specifically, at a cross section, the plate thickness increases as the distance from the vicinity of the top part of the bend section increases, and as a distance from the vicinity of an end of the bend section increases the plate thickness decreases and thereafter increases again, and beyond a position separated by a distance corresponding to 1.5 times the original plate thickness from the position of the end of the bend section, the plate thickness becomes the original plate thickness. Here, the term "vicinity of the top part of the bend section" means one point within a range of ±0.1 mm from the top part. The term "vicinity of an end of the bend section" means one point within a range of ±0.1 mm from an end of the bend section, that is, a boundary between the bend section and a flat section. The term "original plate thickness" means the average plate thickness of the steel plate that is the starting material. The "original plate thickness" corresponds to the average plate thickness of the flat section.

The above described press-formed product is excellent in three-point bending characteristics and axial compressive deformation characteristics. This is because, although in the conventional bending method illustrated in the above described FIG. 1A, the plate thickness excessively decreases at the bend section, particularly the plate thickness at the top part of the bend section, in the bending method described in (a) above the plate thickness at the top part of the bend section does not decrease significantly, and the plate thickness decreases at the flat sections at the periphery of the bend section. For example, in a case where the press-formed product is a member that is mounted in a vehicle, at a time that the member deforms due to a collision or the like, a ridge line part (bend section) of the member bears the impact load. Therefore, the press-formed product produced by the bending method described in the above (a) in which the plate thickness of the ridge line part (bend section) is secured is excellent in three-point bending characteristics and axial compressive deformation characteristics.

(c) In the bending method described in the aforementioned (a), as described above, the interior angle $\theta_1$ of the bend section of the intermediate formed product formed in the first step is smaller than the interior angle $\theta_2$ of the bend section of the press-formed product formed in the second step. Consequently, the intermediate formed product may become unstable on the die assembly when performing press working in the second step. In this case, in the press working in the second step, as the die assembly, it is sufficient for each of the die and the punch to include a pad for restraining the intermediate formed product. The pad that the die includes is called a "die pad", and the pad that the punch includes is called an "inner pad".

The present invention was completed based on the above findings. Embodiments of the present invention are described below while referring to the accompanying drawings. Hereunder, first, a press-formed product is described, and thereafter a production method and a production equipment line that are suitable for producing the press-formed product are described.

[Press-Formed Product]

Figure 3A:
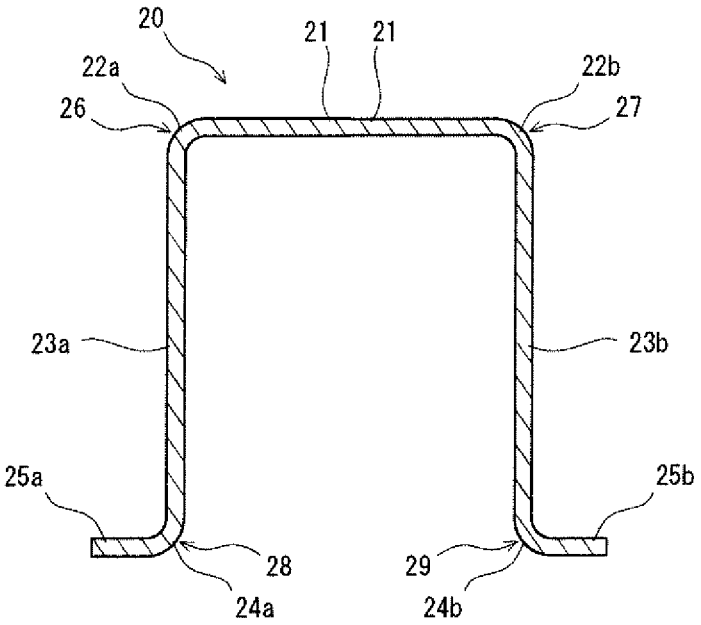
FIG. 3A is a cross-sectional diagram illustrating an example of a press-formed product according to the present embodiments, which illustrates the entire press-formed product.
Figure 3B:
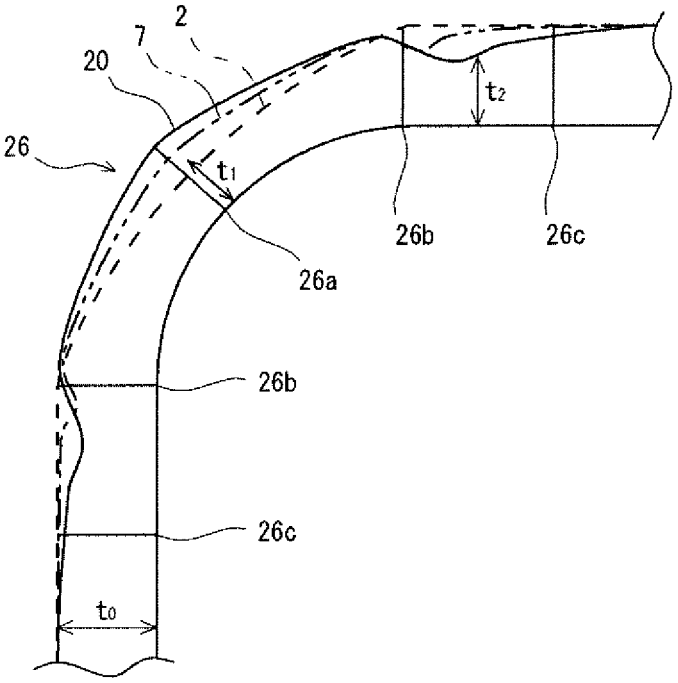
FIG. 3B illustrates a bend section and the vicinity thereof of the press-formed product illustrated in FIG. 3A.

FIG. 3A and FIG. 3B are cross-sectional diagrams illustrating an example of the press-formed product according to the present embodiment. Of these drawings, FIG. 3A illustrates the entire press-formed product, and FIG. 3B illustrates a bend section and the vicinity thereof.

A press-formed product 20 of the present embodiment is made from a metal plate having a tensile strength of 590 MPa or more. The tensile strength may be 780 MPa or more, may be 980 MPa or more, and may be 1180 MPa or more. A high strength steel plate is suitable as a metal plate having such tensile strength. However, an aluminum plate, a titanium plate, a stainless steel plate, a magnesium plate and the like can also be used as the metal plate. A high strength steel plate having a tensile strength of 1180 MPa or more is preferable as the metal plate.

As shown in FIG. 3A, the press-formed product 20 of the present embodiment has a hat-shaped cross-sectional shape, and includes a top plate part 21, two vertical wall parts 23*a* and 23*b*, two upper-side ridge line parts 22*a* and 22*b*, two flange parts 25*a* and 25*b*, and two lower-side ridge line parts 24*a* and 24*b*. The upper-side ridge line parts 22*a* and 22*b* connect the top plate part 21 and the vertical wall parts 23*a* and 23*b*. The lower-side ridge line parts 24*a* and 24*b* connect the vertical wall parts 23*a* and 23*b* and the flange parts 25*a* and 25*b*.

The press-formed product 20 is produced by a production method of the present embodiment that includes press working (bending) that is divided into two steps. The top plate part 21 and the vertical wall part 23*a* constitute a pair of flat sections, and the upper-side ridge line part 22*a* connecting these flat sections constitutes a bend section 26. Likewise, the top plate part 21 and the vertical wall part 23*b* constitute a pair of flat sections, and the upper-side ridge line part 22*b* connecting these flat sections constitutes a bend section 27. Further, the vertical wall part 23*a* and the flange part 25*a* constitute a pair of flat sections, and the lower-side ridge line part 24*a* connecting these flat sections constitutes a bend section 28. Likewise, the vertical wall part 23*b* and the flange part 25*b* constitute a pair of flat sections, and the lower-side ridge line part 24*b* connecting these flat sections constitutes a bend section 29.

In FIG. 3B, the bend section 26 and the vicinity thereof in the press-formed product 20 of the present embodiment are representatively shown, with the contour thereof being indicated by a solid line. The states of the other bend sections 27 to 29 and the vicinities thereof are similar to the state shown in FIG. 3B. In addition, in FIG. 3B, the contour of the bend section 5 of the press-formed product 2 that is obtained by the conventional bending method illustrated in the above described FIG. 1A is shown by a broken line, and the contour of the bend section 8 of the press-formed product 7 that is obtained by the bending method of Patent Literature 1 illustrated in the above described FIG. 2A and FIG. 2B is shown by a chain double-dashed line.

As shown in FIG. 3B, the press-formed product 20 of the present embodiment has a characteristic plate thickness distribution at the bend section 26 and the vicinity thereof. Specifically, the plate thickness increases as the distance from the vicinity of a top part 26*a* of the bend section 26 increases. Further, as the distance from the vicinity of an end (a so-called "bend R end") 26*b* of the bend section 26 increases, the plate thickness decreases and thereafter increases again. In addition, beyond a position 26*c* that is separated by a distance corresponding to 1.5 times an original plate thickness to from the position of the end 26*b* of the bend section 26, the plate thickness becomes the original plate thickness to.

This plate thickness distribution is obtained by the production method of the present embodiment. In the production method of the present embodiment, the plate thickness is reduced at flat sections (for example: the top plate part 21 and the vertical wall part 23*a*) around the bend section 26, and by this means a decrease in the plate thickness of the bend section 26 (for example: the upper-side ridge line part 22*a*) is suppressed. For example, in a case where a press-formed product with a hat-shaped cross section that has the above described plate thickness distribution is a member that is mounted in a vehicle, at a time that the member deforms due to a collision or the like, the upper-side ridge line parts 22*a* and 22*b* of the member bear the impact load. In this case, because the plate thickness of the upper-side ridge line parts 22*a* and 22*b* that are the bend section 26 is secured, the member is excellent in three-point bending characteristics and axial compressive deformation characteristics.

Figure 4:
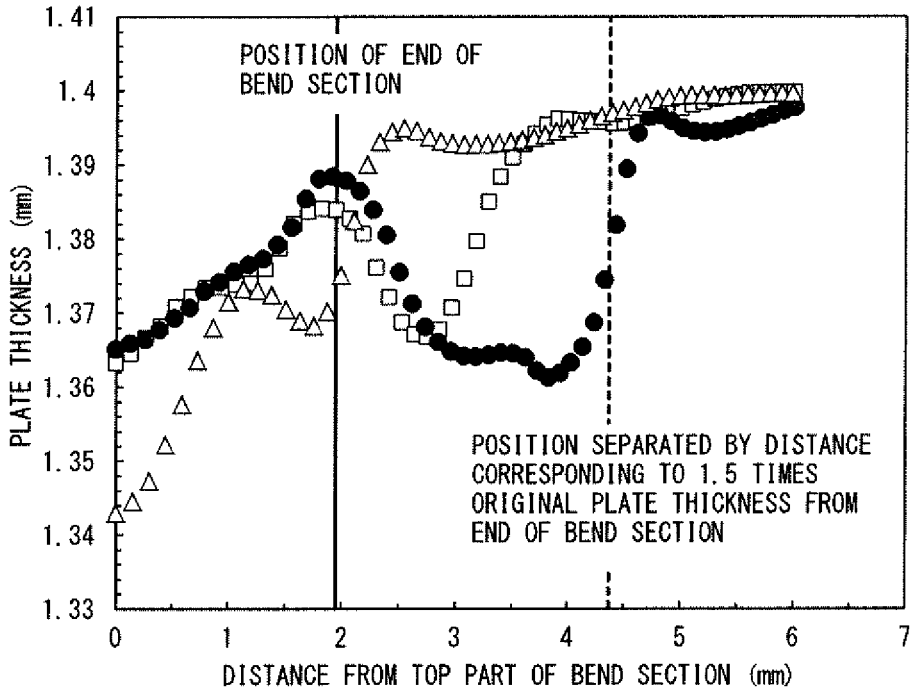
FIG. 4 is a view illustrating an example of a relation between a distance from a top part of a bend section and a plate thickness.
Figure 5:
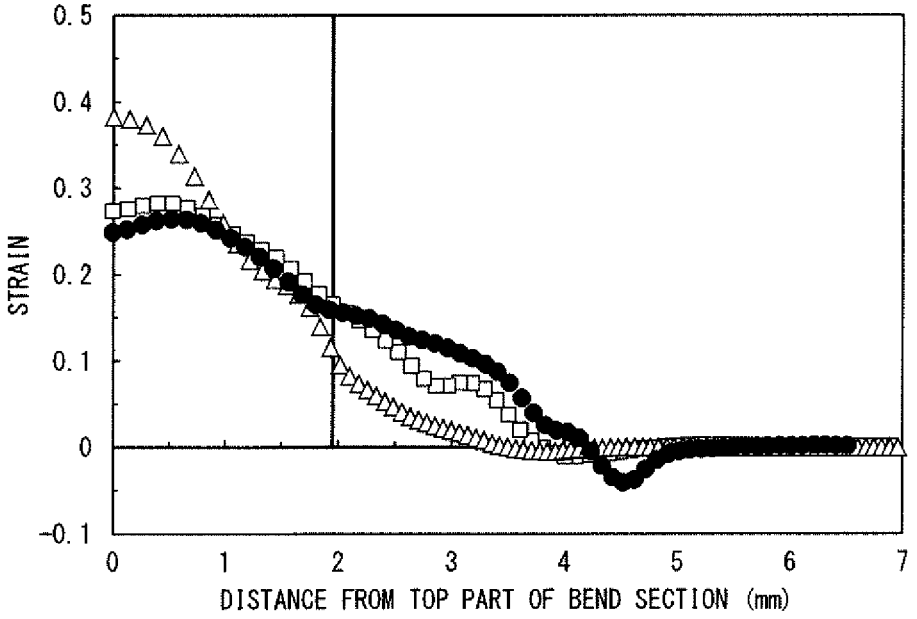
FIG. 5 is a view illustrating an example of a relation between a distance from a top part of a bend section and surface layer strain at the bend section.

FIG. 4 is a view illustrating examples of a relation between a distance from a top part of a bend section and a plate thickness at a cross section of a press-formed product. FIG. 5 is a view illustrating examples of a relation between a distance from a top part of a bend section and the surface layer strain at the bend section at a cross section of a press-formed product. In FIG. 4 and FIG. 5, a circular mark indicates the press-formed product 20 obtained by the production method of the present embodiment (hereunder, also referred to as "Inventive Example of the present invention"). A triangular mark indicates the press-formed product 2 obtained by the conventional bending method illustrated in the above described FIG. 1A (hereunder, also referred to as "Comparative Example 1"). A square mark indicates the press-formed product 7 obtained by the bending method of Patent Literature 1 illustrated in the above described FIG. 2A and FIG. 2B (hereunder, also referred to as "Comparative Example 2").

Figure 6:
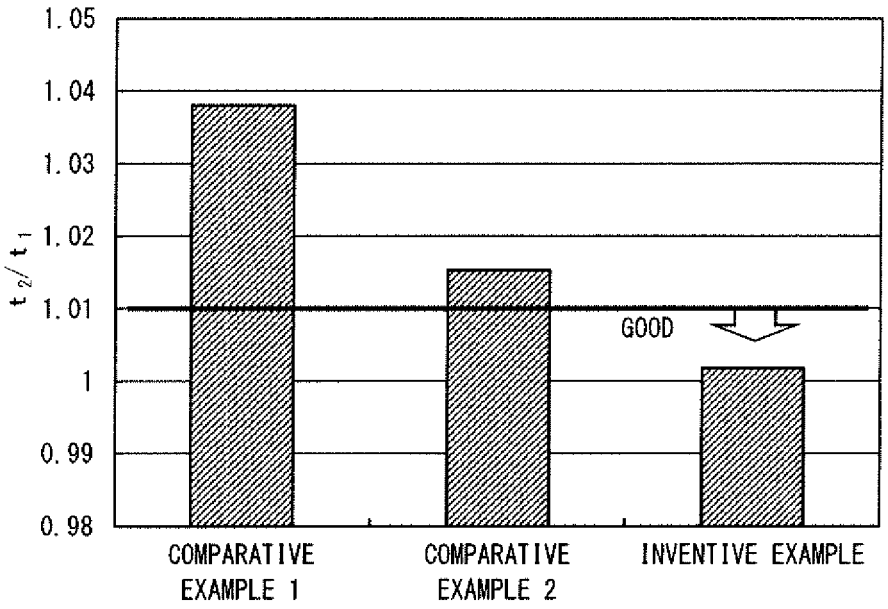
FIG. 6 is a view illustrating an example of a ratio "$t_2/t_1$" between an average value $t_2$ of a plate thickness of a flat section in an area from a position of an end of a bend section to a position separated therefrom by a distance corresponding to 1.5 times the original plate thickness, and a plate thickness $t_1$ of a top part of the bend section.

FIG. 6 is a view illustrating, with respect to a cross section of a press-formed product, examples of a ratio "$t_2/t_1$" between an average value $t_2$ of the plate thickness at a flat section in a region extending from the position of an end of the bend section to a position separated therefrom by a distance corresponding to 1.5 times the original plate thickness, and a plate thickness $t_1$ of a top part of the bend section. In FIG. 6, results with respect to the press-formed product 20 of the Inventive Example of the present invention, the press-formed product 2 of Comparative Example 1, and the press-formed product 7 of the Comparative Example 2 are shown side by side.

In the respective press-formed products 20, 2 and 7 of the Inventive Example of the present invention, Comparative Example 1 and Comparative Example 2, the bending radius $R_2$ of the respective bend sections 26, 5 and 8 is 1.5 mm, and the exterior angle $A_2$ of the respective bend sections 26, 5 and 8 is 90°. The bend section 5 of the press-formed product 2 of Comparative Example 1 was formed by press working that was performed in only one step.

The bend section 8 of the press-formed product 7 of Comparative Example 2 was formed by press working that was divided into two steps. Specifically, by press working in a first step, a bend section having a bending radius $R_1$ of 3 mm that is larger than the bending radius $R_2$ of the bend section 8 of the press-formed product 7 was formed, and by press working in a second step, the bend section 8 having a bending radius $R_2$ of 1.5 mm was formed. In other words, the bending radius ratio "$R_1/R_2$" was made 2.0. Further, the exterior angle $A_1$ of the bend section formed in the first step and the exterior angle $A_2$ of the bend section formed in the second step were made the same angle of 90°. In other words, an exterior angle ratio "$A_1/A_2$" was made 1.0. In short, the press-formed product 7 of Comparative Example 2 was formed according to conditions satisfied only the aforementioned Formulae (2) and (4) among the aforementioned Formulae (1) to (5).

The bend section 26 of the press-formed product 20 of the Inventive Example of the present invention was formed by press working that was divided into two steps. Specifically, by press working in a first step, a bend section having a bending radius $R_1$ of 3 mm that is larger than the bending radius $R_2$ of the bend section 26 of the press-formed product 20 was formed, and by press working in a second step, the bend section 26 having a bending radius $R_2$ of 1.5 mm was formed. In other words, the bending radius ratio "$R_1/R_2$" was made 2.0. Further, by the press working in the first step, the bend section was formed to have an exterior angle $A_1$ of 120° that is larger than the exterior angle $A_2$ of the bend section 26 of the press-formed product 20, and by the press working in the second step, the bend section 26 was formed to have an exterior angle $A_2$ of 90°. In other words, the exterior angle ratio "$A_1/A_2$" was made 1.33. In short, the press-formed product 20 of the Inventive Example of the present invention was formed according to conditions that satisfied all of the aforementioned Formulae (1) to (5).

As indicated by triangular marks in FIG. 4, in Comparative Example 1 the plate thickness significantly decreased at the top part of the bend section 5. In contrast, as indicated by the square marks in FIG. 4, the decrease in the plate thickness at the top part of the bend section 8 in Comparative Example 2 is less than the decrease in the plate thickness in Comparative Example 1. Similarly, as indicated by circular marks in FIG. 4, the decrease in the plate thickness at the top part of the bend section 26 in the Inventive Example of the present invention is less than the decrease in the plate thickness in Comparative Example 1.

In addition, the plate thickness at the top part 26*a* of the bend section 26 of the press-formed product 20 of the Inventive Example of the present invention is greater than the plate thickness at the top part of the bend section 8 in the press-formed product 7 of Comparative Example 1. Furthermore, a region in which the plate thickness decreases in a flat section at the periphery of the bend section 26 in the press-formed product 20 of the Inventive Example of the present invention is wider than a region in which the plate thickness decreases in a flat section at the periphery of the bend section 8 in the press-formed product 7 of Comparative Example 2.

The reason for the above situation will also be understood from the diagram illustrated in FIG. 5. In other words, the reason is that surface layer strain (see the circular marks in FIG. 5) that occurs in the vicinity of the bend section of the press-formed product 20 of the Inventive Example of the present invention occurs over a wider area in comparison to surface layer strain (see the square marks in FIG. 5) that occurs in the vicinity of the bend section of the press-formed product 7 of Comparative Example 2.

In addition, as shown in FIG. 6, the plate thickness ratio "$t_2/t_1$" for the press-formed product 20 of the Inventive Example of the present invention is less than 1.01, and is smaller than the plate thickness ratio "$t_2/t_1$" for the press-formed product 2 of Comparative Example 1 and for the press-formed product 7 of Comparative Example 2. In other words, according to the production method of the present embodiment, to compensate for the decrease in the plate thickness of the flat sections at the periphery of the bend section, a decrease in the plate thickness of the top part 26*a* of the bend section 26 is suppressed.

The plate thickness ratio "$t_2/t_1$" for the press-formed product 20 is preferably less than 1.01, and more preferably is 1.00 or more and less than 1.01.

The bending radius of the bend section in the press-formed product of the present embodiment is, for example, a small value of 0 to 3 mm. In addition, the press-formed product has the aforementioned plate thickness distribution. Therefore, the press-formed product is excellent in bending rigidity and torsional rigidity in a case where a static load is placed thereon. Further, in a case where an impact load is applied, buckling that takes the top part of the bend section as an origin is suppressed, and a high initial load and high impact energy absorption amount are obtained. Thus, the press-formed product is excellent in three-point bending characteristics and axial compressive deformation characteristics. Accordingly, the press-formed product of the present embodiment is suitable, for example, as a frame member of an automobile body (for example, a cross member, a side member, a side sill and a pillar), and as various components of an automobile (for example, a door impact beam, a toe-control link and a suspension arm).

Note that, in the case of the press-formed product 20 having a hat-shaped cross section as in the present embodiment, preferably the upper-side ridge line parts 22*a* and 22*b* and the lower-side ridge line parts 24*a* and 24*b* that are bend sections each have the above described bending radii and plate thickness distribution. However, as long as the performance as a press-formed product is satisfied, a configuration may also be adopted in which any one of the upper-side ridge line parts 22*a* and 22*b* and the lower-side ridge line parts 24*a* and 24*b* has the above described bending radii and plate thickness distribution.

The press-formed product is not limited to the above described hat-shaped cross section. For example, the press-formed product may have a groove-shaped cross section that does not have flange parts. The press-formed product having a groove-shaped cross section includes a top plate part, two vertical wall parts, and a ridge line part connecting the top plate part and each vertical wall part. In this case, the top plate part and vertical wall parts constitute a pair of flat sections, and the ridge line part connecting these flat sections constitutes a bend section.

[Production Method and Production Equipment Line for Producing Press-Formed Product]

Figure 7A:
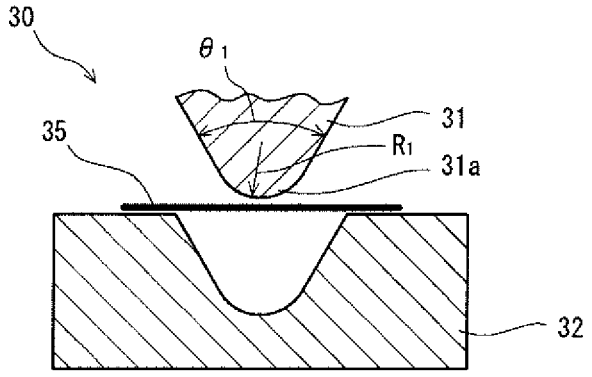
FIG. 7A is a cross-sectional diagram illustrating the basic concept of a production method for producing a press-formed product according to the present embodiments, which illustrates a situation when performing processing in a first step.
Figure 7B:
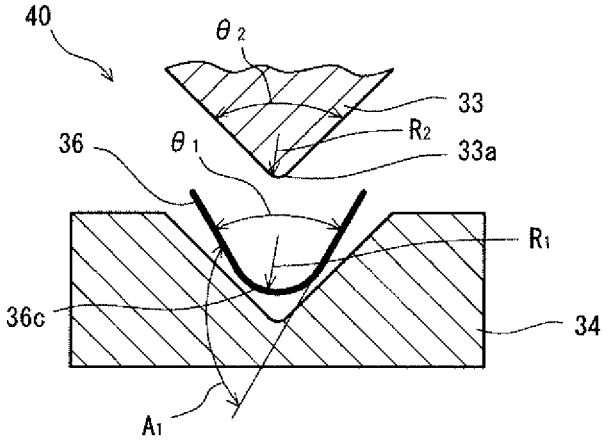
FIG. 7B is a cross-sectional diagram illustrating the basic concept of the production method for producing a press-formed product according to the present embodiments, which illustrates a situation when performing processing in a second step.
Figure 7C:
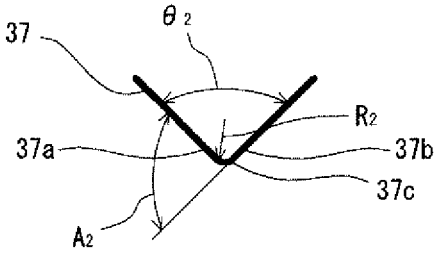
FIG. 7C illustrates a press-formed product that is produced as a result of undergoing the bending illustrated in FIG. 7A and FIG. 7B.

FIG. 7A to FIG. 7C are cross-sectional diagrams illustrating the basic concept of the production method for producing a press-formed product according to the present embodiment. Among these drawings, FIG. 7A illustrates a situation when performing processing in a first step, and FIG. 7B illustrates a situation when performing processing in a second step. FIG. 7C illustrates a press-formed product 37 produced as a result of undergoing the processing illustrated in FIG. 7A and FIG. 7B.

Figure 8A:
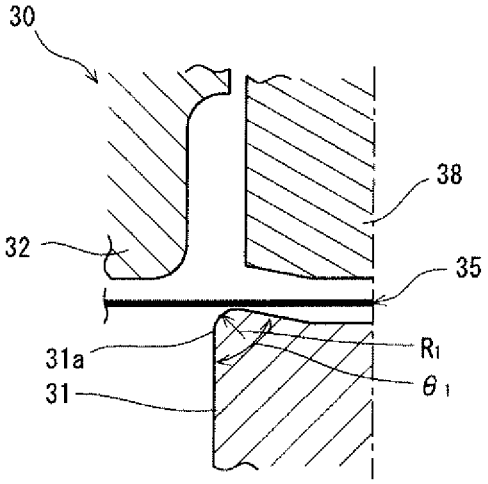
FIG. 8A is a cross-sectional diagram illustrating an overview of a production method according to a first embodiment, which illustrates a state prior to processing that is to be performed in a first step.
Figure 8B:
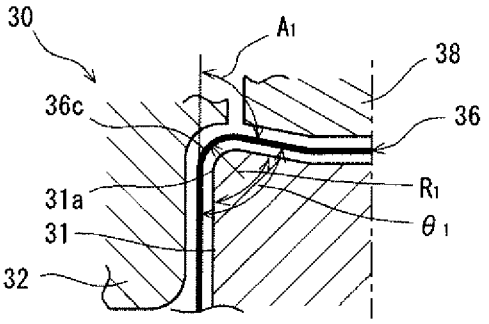
FIG. 8B is a cross-sectional diagram illustrating an overview of the production method according to the first embodiment, which illustrates a state when processing is completed in the first step.
Figure 9A:
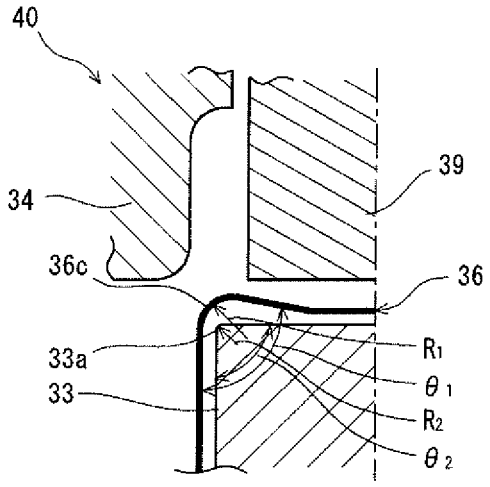
FIG. 9A is a cross-sectional diagram illustrating an overview of the production method according to the first embodiment, which illustrates a state prior to processing that is to be performed in a second step.
Figure 9B:
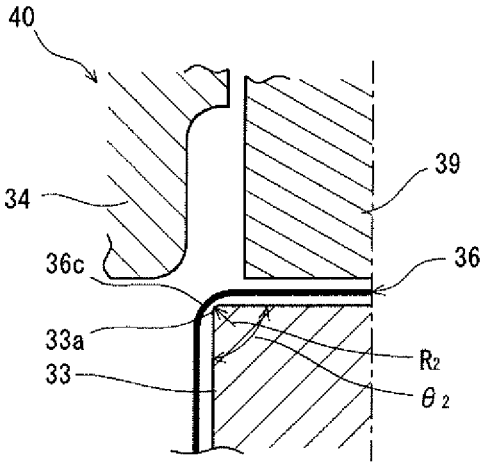
FIG. 9B is a cross-sectional diagram illustrating an overview of the production method according to the first embodiment, which illustrates a state at an initial stage of processing in the second step.
Figure 9C:
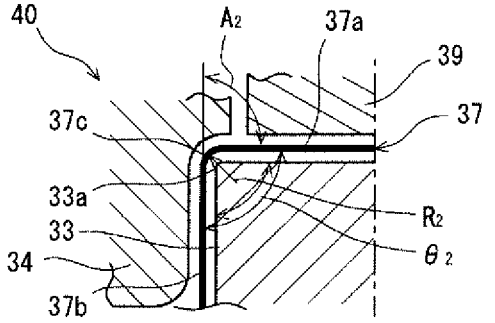
FIG. 9C is a cross-sectional diagram illustrating an overview of the production method according to the first embodiment, which illustrates a state when processing is completed in the second step.
Figure 10A:
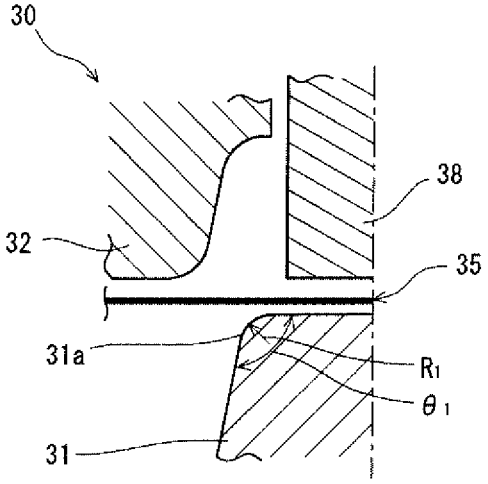
FIG. 10A is a cross-sectional diagram illustrating an overview of a production method according to a second embodiment, which illustrates a state prior to processing that is to be performed in a first step.
Figure 10B:
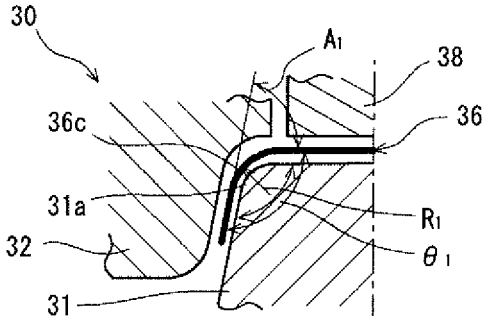
FIG. 10B is a cross-sectional diagram illustrating an overview of the production method according to the second embodiment, which illustrates a state when processing is completed in the first step.
Figure 11A:
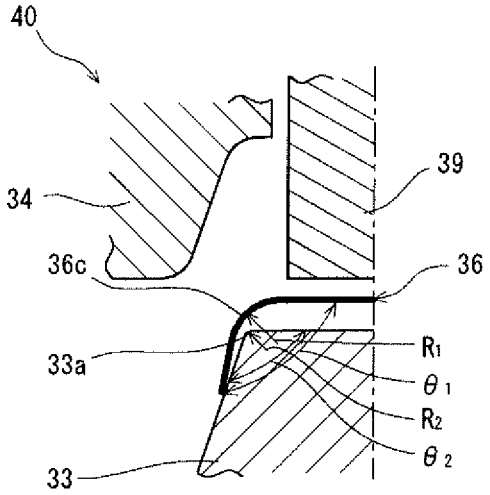
FIG. 11A is a cross-sectional diagram illustrating an overview of the production method according to the second embodiment, which illustrates a state prior to processing that is to be performed in a second step.
Figure 11B:
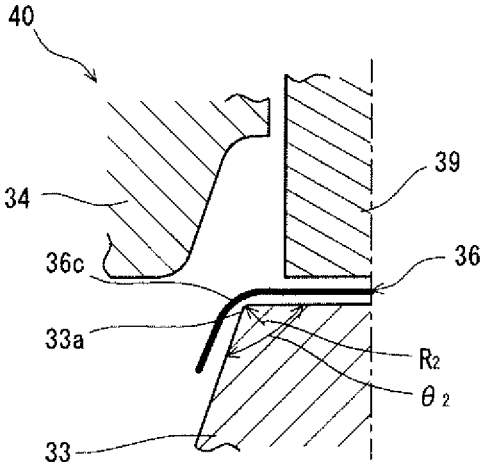
FIG. 11B is a cross-sectional diagram illustrating an overview of the production method according to the second embodiment, which illustrates a state at an initial stage of processing in the second step.
Figure 11C:
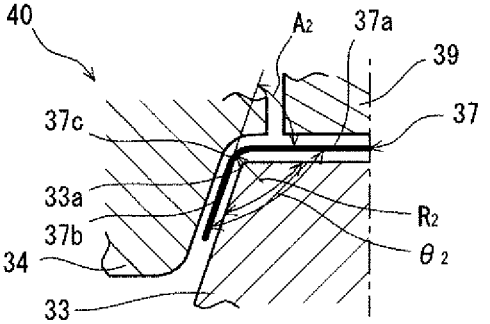
FIG. 11C is a cross-sectional diagram illustrating an overview of the production method according to the second embodiment, which illustrates a state when processing is completed in the second step.
Figure 12A:
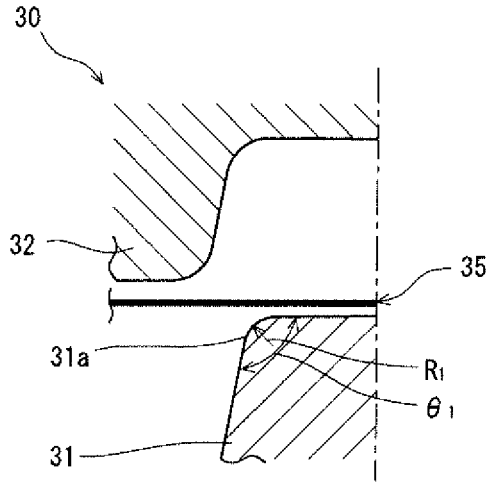
FIG. 12A is a cross-sectional diagram illustrating an overview of a production method according to a third embodiment, which illustrates a state prior to processing that is to be performed in a first step.
Figure 12B:
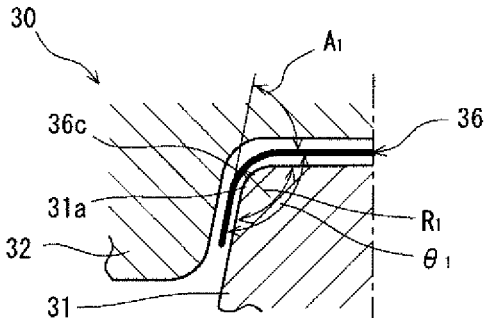
FIG. 12B is a cross-sectional diagram illustrating an overview of the production method according to the third embodiment, which illustrates a state when processing is completed in the first step.
Figure 13A:
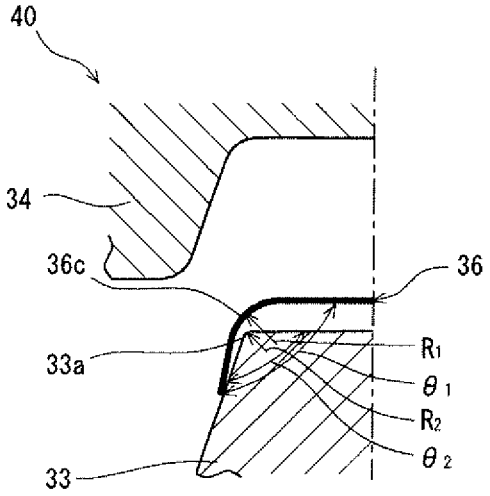
FIG. 13A is a cross-sectional diagram illustrating an overview of the production method according to the third embodiment, which illustrates a state prior to processing that is to be performed in a second step.
Figure 13B:
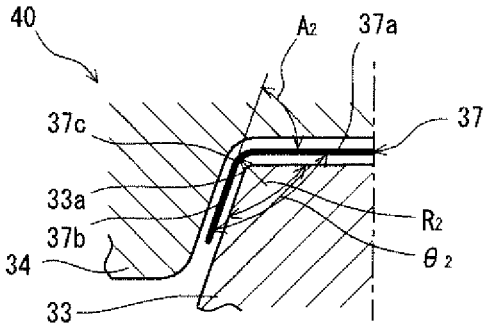
FIG. 13B is a cross-sectional diagram illustrating an overview of the production method according to the third embodiment, which illustrates a state when processing is completed in the second step.

FIG. 8A, FIG. 8B and FIG. 9A to FIG. 9C are cross-sectional diagrams that illustrate an overview of a production method of a first embodiment as a specific example. FIG. 10A, FIG. 10B and FIG. 11A to FIG. 11C are cross-sectional diagrams that illustrate an overview of a production method of a second embodiment as a specific example. FIG. 12A, FIG. 12B, FIG. 13A and FIG. 13B are cross-sectional diagrams that illustrate an overview of a production method of a third embodiment as a specific example. Among these drawings, FIG. 8A, FIG. 8B, FIG. 10A, FIG. 10B, FIG. 12A and FIG. 12B illustrate a situation when performing processing in a first step. FIG. 8A, FIG. 10A and FIG. 12A illustrate a state prior to processing, and FIG. 8B, FIG. 10B and FIG. 12B illustrate a state when processing is completed. Further, FIG. 9A to FIG. 9C, FIG. 11A to FIG. 11C, FIG. 13A and FIG. 13B illustrate a situation when performing processing in a second step. FIG. 9A, FIG. 11A and FIG. 13A illustrate a state prior to processing, FIG. 9B and FIG. 11B illustrate a state at an initial stage of processing, and the FIG. 9C, FIG. 11C and FIG. 13B illustrate a state when processing is completed. A dashed line in these drawings represents a center line.

In the present embodiment, the press-formed product is produced by press working that is divided into two steps. In other words, as shown in FIG. 7A to FIG. 13B, the press-formed product 37 is produced by undergoing a first forming step as a first step and a second forming step as a second step in that order. In the first forming step, an intermediate formed product 36 is formed from a metal plate 35 that is the starting material by press working using a first press apparatus 30. In the second forming step, the press-formed product 37 is formed from the intermediate formed product 36 by press working using a second press apparatus 40. Thus, the first press apparatus 30 and the second press apparatus 40 constitute a series of production equipment lines.

As shown in FIG. 7A, FIG. 8A, FIG. 8B, FIG. 10A, FIG. 10B, FIG. 12A and FIG. 12B, as a die assembly, the first press apparatus 30 includes a first punch 31 and a first die 32 that are a pair. In addition, the first and second embodiments that are illustrated in FIG. 8A, FIG. 8B, FIG. 10A and FIG. 10B include a die pad 38 and an inner pad (not illustrated in the drawings). The die pad 38 is provided in the first die 32, and the inner pad is provided in the first punch 31. The die pad 38 and the inner pad restrain and position the metal plate 35 at the time of press working in the first forming step. However, a die pad and an inner pad need not be provided, as in case of the third embodiment that is illustrated in FIG. 12A and FIG. 12B.

As illustrated in FIG. 7B, FIG. 9A to FIG. 9C, FIG. 11A to FIG. 11C, FIG. 13A and FIG. 13B, as a die assembly, the second press apparatus 40 includes a second punch 33 and a second die 34 that are a pair. In addition, the first and second embodiments that are illustrated in FIG. 9A to FIG. 9C, and FIG. 11A to FIG. 11C include a die pad 39 and an inner pad (not illustrated in the drawings). The die pad 39 is provided in the second die 34, and the inner pad is provided in the second punch 33. The die pad 39 and the inner pad restrain and position the intermediate formed product 36 at the time of press working in the second forming step. However, a die pad and an inner pad need not be provided, as in case of the third embodiment that is illustrated in FIG. 13A to FIG. 13B.

As illustrated in FIG. 7B, FIG. 9A to FIG. 9C, FIG. 11A to FIG. 11C, and FIG. 13A and FIG. 13B, the second punch 33 of the second press apparatus 40 has a shoulder part 33*a* for forming a bend section 37*c* of the press-formed product 37. An angle that a pair of faces that connect to the shoulder part 33*a* form is the same as the interior angle $\theta_2$ of the bend section 37*c* of the press-formed product 37. In other words, the exterior angle of the angle of the shoulder part 33*a* is the same as the exterior angle $A_2$ of the bend section 37*c* of the press-formed product 37. Further, the radius of the shoulder part 33*a* is the same as the bending radius $R_2$ of the bend section 37*c* of the press-formed product 37.

On the other hand, as illustrated in FIG. 7A, FIG. 8A, FIG. 8B, FIG. 10A, FIG. 10B, FIG. 12A and FIG. 12B, the first punch 31 of the first press apparatus 30 has a shoulder part 31*a* for forming a bend section 36*c* of the intermediate formed product 36. An angle that a pair of faces that connect to the shoulder part 31*a* form is smaller than the interior angle $\theta_2$ of the bend section 37*c* of the press-formed product 37, and is the same as the interior angle $\theta_1$ of the bend section 36*c* of the intermediate formed product 36. In other words, the exterior angle of the angle of the shoulder part 31*a* is greater than the exterior angle $A_2$ of the bend section 37*c* of the press-formed product 37, and is the same as the exterior angle $A_1$ of the bend section 36*c* of the intermediate formed product 36. Further, the radius of the shoulder part 31*a* is larger than the bending radius $R_2$ of the bend section 37*c* of the press-formed product 37, and is the same as the bending radius $R_1$ of the bend section 36*c* of the intermediate formed product 36.

The radius and angle (exterior angle) of the shoulder part 31*a* of the first punch 31, and the radius and angle (exterior angle) of the shoulder part 33*a* of the second punch 33 are set so that the bending radius $R_1$ and interior angle $\theta_1$ (exterior angle $A_1$) of the bend section 36*c* of the intermediate formed product 36 and the bending radius $R_2$ and the interior angle $\theta_2$ (exterior angle $A_2$) of the bend section 37*c* of the press-formed product 37 satisfy the conditions of the above described Formulae (1) to (3) or the above described Formulae (1), (4) and (5).

In the production method of the present embodiment, the press-formed product 37 is produced using the first press apparatus 30 and the second press apparatus 40 that are configured as described above. First, as shown in FIG. 7A, FIG. 8A, FIG. 10A and FIG. 12A, the metal plate 35 that serves as a starting material is prepared in a starting material preparation step. As described above, the metal plate 35 is a metal plate (for example, a high strength steel plate) that has a tensile strength of 590 MPa or more.

In the first forming step, as illustrated in FIG. 7A, FIG. 8A, FIG. 8B, FIG. 10A, FIG. 10B, FIG. 12A and FIG. 12B, press working is performed on the metal plate 35 using the first punch 31 and the first die 32, and depending on the case, also using the die pad 38 and the inner pad. At such time, the bend section 36*c* is formed at a portion corresponding to the bend section 37*c* of the press-formed product 37 by the shoulder part 31*a* of the first punch 31 and the first die 32. By this means, the intermediate formed product 36 is formed that has the bend section 36*c* in which the bending radius is $R_1$ and the interior angle is $\theta_1$ (exterior angle is $A_1$).

Next, in the second forming step, as illustrated in FIG. 7B, FIG. 9A to FIG. 9C, FIG. 11A to FIG. 11C, and FIG. 13A and FIG. 13B, press working is performed on the intermediate formed product 36 using the second punch 33 and the second die 34, and depending on the case, also using the die pad 39 and the inner pad. At such time, the bend section 37*c* is formed at a portion of the bend section 36*c* of the intermediate formed product 36 by the shoulder part 33*a* of the second punch 33 and the second die 34. By this means, the press-formed product 37 is formed that has the bend section 37*c* in which the bending radius is $R_2$ and the interior angle is $\theta_2$ (exterior angle is $A_2$).

The press-formed product 37 illustrated in FIG. 7B, FIG. 9C, FIG. 11C and FIG. 13B, for example, is the press-formed product 20 having a hat-shaped cross section that is shown in FIG. 3A or is a press-formed product having a groove-shaped cross section. In the former case, the bend section 37*c* of the press-formed product 37, for example, is the upper-side ridge line parts 22*a* and 22*b* and the lower-side ridge line parts 24*a* and 24*b* of the press-formed product 20. The flat sections 37*a* and 37*b* connecting to the bend section 37*c* of the press-formed product 37 are, for example, the top plate part 21, the vertical wall parts 23*a* and 23*b*, and the flange parts 25*a* and 25*b* of the press-formed product 20.

According to the production method of the present embodiment, the plate thickness can be reduced at the flat sections 37*a* and 37*b* at the periphery of the bend section 37*c*, and a decrease in the plate thickness of the bend section 37*c* can be suppressed. By this means, an occurrence region of surface layer strain that occurs at the bend section 37*c* is expanded, and the surface layer strain in the bend section decreases. Therefore, according to the production method of the present embodiment, occurrence of cracking at the bend section can be suppressed, and the press-formed product 37 having the bend section 37*c* that has a smaller bending radius can be produced.

Figure 14:
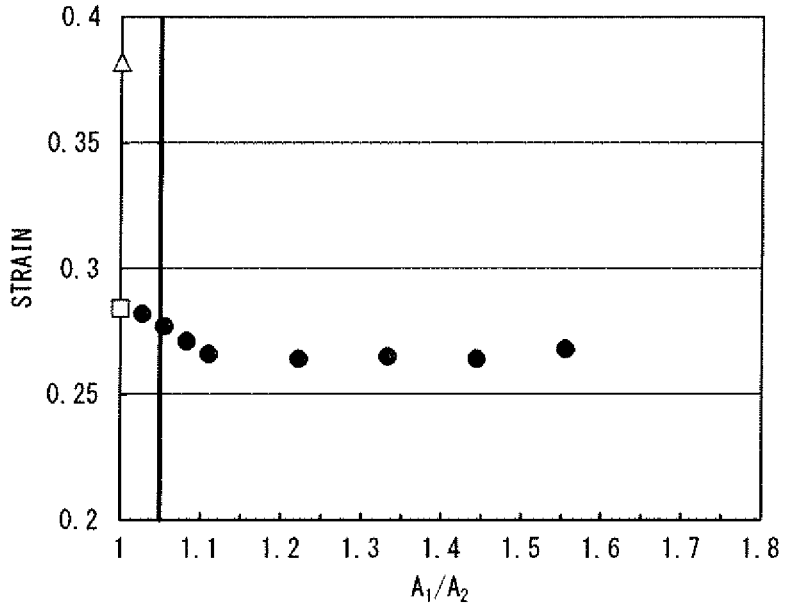
FIG. 14 is a view illustrating a relation between an exterior angle ratio "$A_1/A_2$" at a bend section and surface layer strain at the bend section.

FIG. 14 is a view that shows a relation between the exterior angle ratio "$A_1/A_2$" at the bend section and the surface layer strain at the bend section. In FIG. 14, a circular mark indicates a case where production was performed according to the production method of the Inventive Example of the present invention, a triangular mark indicates a case where production was performed according to the production method of Comparative Example 1, and a square mark indicates a case where production was performed according to the production method of Comparative Example 2. Note that, in the case of the Inventive Example of the present invention and Comparative Example 2, the value of R/t for the press working in the first step was 2.14, and the value of R/t for the press working in the second step was 1.07. Further in the case of Comparative Example 1, the value of R/t in the press working in the only one step was 1.07.

As shown in FIG. 14, it is found that when the exterior angle ratio "$A_1/A_2$" is more than 1.05, the surface layer strain in the bend section becomes less than in both Comparative Example 1 and Comparative Example 2. In other words, it is found that when a condition that the exterior angle ratio "$A_1/A_2$" is more than 1.05 exists, a bend section having a smaller bending radius can be formed while suppressing cracking. This condition corresponds to a condition that satisfies the above described Formula (1).

Figure 15:
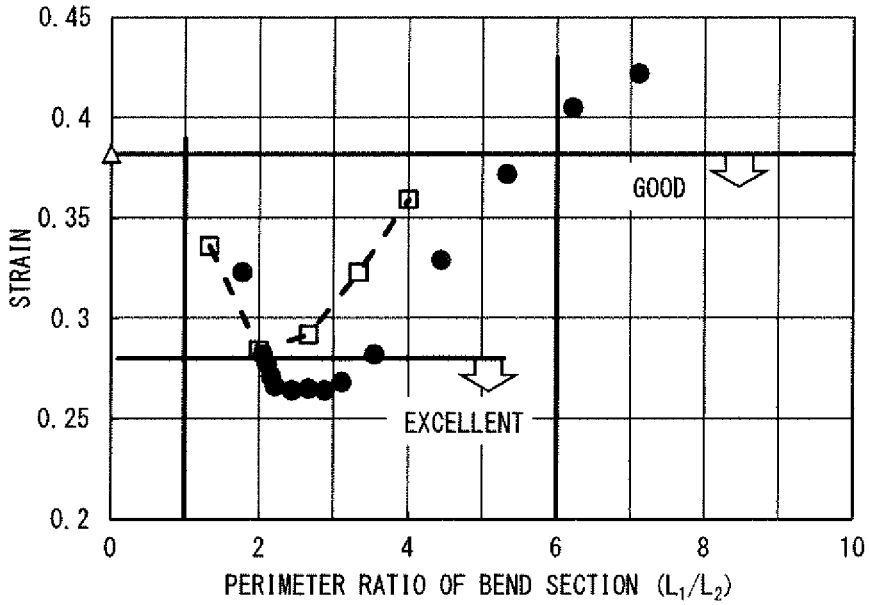
FIG. 15 is a view illustrating a relation between a perimeter ratio "$L_1/L_2$" of a bend section and surface layer strain at the bend section.

FIG. 15 is a view illustrating a relation between the perimeter ratio "$L_1/L_2$" of a bend section and the surface layer strain at the bend section. In FIG. 15, a circular mark indicates a case where production was performed according to the production method of the Inventive Example of the present invention, a triangular mark indicates a case where production was performed according to the production method of Comparative Example 1, and a square mark indicates a case where production was performed according to the production method of Comparative Example 2.

In the case of each of the production methods according to the Inventive Example of the present invention, Comparative Example 1 and Comparative Example 2, the bending radius $R_2$ of the bend section of the final press-formed product was made 1.5 mm, and the exterior angle $A_2$ of the bend section was made 90°. In the production method of Comparative Example 1, the bend section was formed by press working in only one step.

In the production method of Comparative Example 2, the bend section was formed by press working that was divided into two steps. In the case of Comparative Example 2, with respect to the bend section formed by press working in the first step (first forming step), the bending radius $R_1$ was changed to various values within a range of values that were greater than the bending radius $R_2$ of the press-formed product while maintaining the exterior angle $A_1$ at the same angle as the exterior angle $A_2$ of the press-formed product.

In the production method of the Inventive Example of the present invention, the bend section was formed by press working that was divided into two steps. In the case of the Inventive Example of the present invention, with respect to the bend section that was formed by press working in the first step (first forming step), the bending radius $R_1$ was changed to various values within a range of values that were greater than the bending radius $R_2$ of the press-formed product, and the exterior angle $A_1$ was also changed to various values within a range of values that were greater than the exterior angle $A_2$ of the press-formed product.

The following facts are indicated by the diagram illustrated in FIG. 15. When the Inventive Examples of the present invention that are indicated by circular marks and Comparative Example 1 that is indicated by a triangular mark are compared, it is found that when the perimeter ratio "$L_1/L_2$" is more than 1.0 and is less than 6.0, surface layer strain in the bend section is less than in Comparative Example 1. Here, the perimeter ratio "$L_1/L_2$" is represented by the aforementioned Formula (iii). In addition, the bending radius ratio "$R_1/R_2$" is more than 1.0 in each of the Inventive Examples of the present invention that are indicated by circular marks. Accordingly, it is found that when there is a condition that satisfies the aforementioned Formula (3) and also a condition that satisfies the aforementioned Formula (2), the surface layer strain becomes less than in Comparative Example 1, and the effect of the Inventive Example of the present invention with respect to cracking is exhibited.

When the Inventive Examples of the present invention that are indicated by circular marks and Comparative Examples 2 that are indicated by square marks are compared, it is found that when the perimeter ratio "$L_1/L_2$" is more than 1.0 and is less than 3.5, surface layer strain in the bend section becomes less than in Comparative Example 2. Here, the perimeter ratio "$L_1/L_2$" is represented by the aforementioned Formula (iii). In addition, among the Inventive Examples of the present invention, which are indicated by circular marks, the Inventive Examples in which the surface layer strain is less than in Comparative Example 2 are the Inventive Examples in which the bending radius ratio "$R_1/R_2$" is more than 1.5. Accordingly, it is found that when there is a condition that satisfies the aforementioned Formula (5) and also a condition that satisfies the aforementioned Formula (3), surface layer strain becomes less than in Comparative Example 2, and the effect of the Inventive Example of the present invention with respect to cracking is exhibited.

Figure 16:
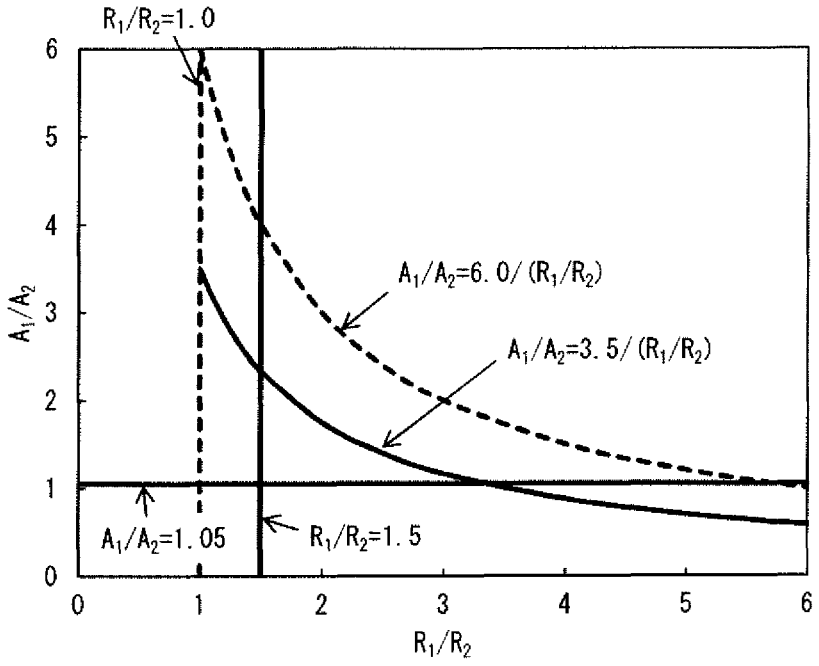
FIG. 16 is a view illustrating a summary of forming conditions according to the production method of the present embodiments.

FIG. 16 is a view illustrating a summary of the forming conditions according to the production method of the present embodiment. In FIG. 16, the abscissa represents the bending radius ratio "$R_1/R_2$" of the bend section, and the ordinate represents the perimeter ratio "$L_1/L_2$" of the bend section. If the bending radius $R_1$ and the exterior angle $A_1$ of the intermediate formed product and the bending radius $R_2$ and the exterior angle $A_2$ of the press-formed product are set within a range that is surrounded by a straight line "$A_1/A_2=1.05$", a straight line "$R_1/R_2=1.0$" and a hyperbolic curve "$A_1/A_2=6.0/(R_1/R_2)$", cracking will be suppressed more than in Comparative Example 1. In other words, it is sufficient to satisfy the conditions of the aforementioned Formulae (1) to (3). In addition, if the bending radius $R_1$ and the exterior angle $A_1$ of the intermediate formed product and the bending radius $R_2$ and the exterior angle $A_2$ of the press-formed product are set within a range that is surrounded by the straight line "$A_1/A_2=1.05$", a straight line "$R_1/R_2=1.5$" and a hyperbolic curve "$A_1/A_2=3.5/(R_1/R_2)$", cracking will be suppressed more than in Comparative Example 2. In other words, more preferably, it is sufficient to satisfy the conditions of the aforementioned Formulae (1), (4) and (5). Further, based on FIG. 16, preferably $R_1/R_2$ is less than 5.5, and more preferably is less than 3.5.

EXAMPLES

Analysis of the formation of press-formed products having the hat-shaped cross section shown in FIG. 3A was performed. The analysis was performed using "LS-DYNA", which is general-purpose structural analysis software. As Comparative Example 1, a press-formed product No. 1 was formed by the conventional bending method illustrated in the above described FIG. 1A. When forming the press-formed product No. 1, the value of R/t in the press working in the only one step was made 1.07.

As Comparative Example 2, press-formed products Nos. 2, 4 and 6 were formed by the bending method disclosed in Patent Literature 1 that is illustrated in the above described FIG. 2A and FIG. 2B. In each of Nos. 2, 4 and 6, the value of R/t in the press working in the second step was made 1.07. In the press working in the first step, the value of R/t was made 1.42 for No. 2, 2.14 for No. 4, and 2.85 for No. 6.

As the Inventive Example of the present invention, press-formed products Nos. 3, 5 and 7 were formed by the production method of the present embodiment. In each of Nos. 3, 5 and 7, the value of R/t in the press working in the second step was made 1.07, similarly to Comparative Example 2. In the press working in the first step, the value of R/t was made 1.42 for No. 3 that is the same value as for No. 2 of Comparative Example 2, the value of R/t was made 2.14 for No. 5 that is the same value as for No. 4 of Comparative Example 2, and the value of R/t was made 2.85 for No. 7 that is the same value as for No. 6 of Comparative Example 2. In each of Nos. 3, 5 and 7, the exterior angle ratio "$A_1/A_2$" was made 1.33.

Further, in each of Nos. 1 to 7, a high strength steel plate having a tensile strength of 1180 MPa-class and a plate thickness of 1.4 mm was used as the metal plate that was the starting material. The specific mechanical properties of the steel plate are as follows:

YP (yield point): 801 MPa

TS (tensile strength): 1197 MPa

El (elongation): 13.6%

The logarithmic strain in the bending direction (circumferential direction of cross section) in the outer surface at the top part of the bend section was determined for each of the press-formed products Nos. 1 to 7. The results are shown in FIG. 17.

Figure 17:
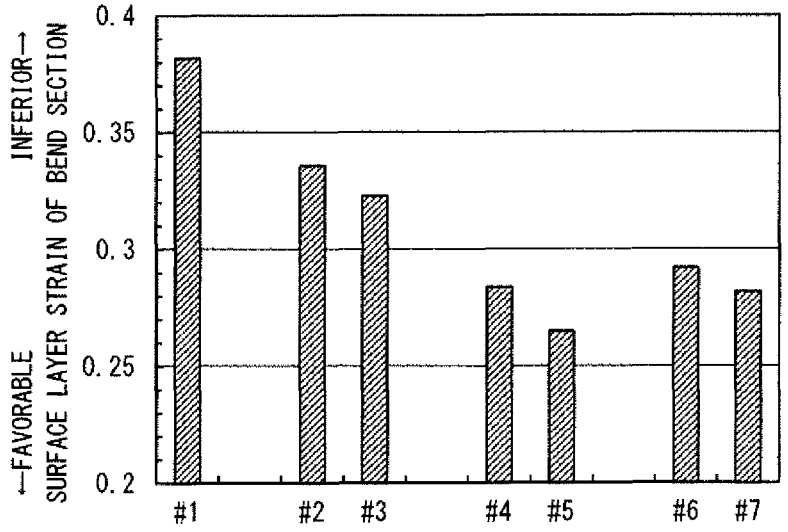
FIG. 17 is a view showing the results of examples.

As shown in FIG. 17, the surface layer strain in the Inventive Example of the present invention (Nos. 3, 5 and 7) was less than the surface layer strain in each of Comparative Example 1 (No. 1) and Comparative Example 2 (Nos. 2, 4 and 6). It was thus clarified that according to the production method of the present embodiment, a press-formed product having a bend section with a smaller bending radius can be produced while suppressing cracking.

The present invention is not limited to the embodiments described above, and various modifications may be made without departing from the spirit and scope of the present invention.

REFERENCE SIGNS LIST

30 First press apparatus
31 First punch
31*a* Shoulder part
32 First die
40 Second press apparatus
33 Second punch
33*a* Shoulder part
34 Second die
35 Metal plate
36 Intermediate formed product
36*c* Bend section
37 Press-formed product
37*a* Flat section
37*b* Flat section
37*c* Bend section

The invention claimed is:

1. A production method for producing a press-formed product, the press-formed product including a pair of flat sections and a bend section connecting the pair of flat sections, in which a bending radius of the bend section is $R_2$ and an interior angle formed by the pair of flat sections is $\theta_2$, the production method comprising:

a starting material preparation step of preparing a metal plate having a tensile strength of 590 MPa or more;

a first forming step of subjecting the metal plate to press working using a first die assembly to form an intermediate formed product having a bend section with a bending radius of $R_1$ (mm) and an interior angle of $\theta_1$ (°) at a portion corresponding to the bend section of the press-formed product; and a second forming step of subjecting the intermediate formed product to press working using a second die assembly to form the press-formed product having the bend section with the bending radius of $R_2$ (mm) and the interior angle of $\theta_2$ (°) at a portion of the bend section of the intermediate formed product;

wherein the bending radius $R_1$ and the interior angle $\theta_1$ of the intermediate formed product and the bending radius $R_2$ and the interior angle $\theta_2$ of the press-formed product satisfy conditions of Formulae (1) to (3) below:

$$1.05<A_1/A_2 \quad (1)$$

$$1.0<R_1/R_2 \quad (2)$$

$$A_1/A_2<6.0/(R_1/R_2) \quad (3);$$

where, in the above Formulae, $A_1$ (°) is a supplementary angle of the interior angle $\theta_1$ of the intermediate formed product, which is represented by Formula (A) below, and $A_2$ (°) is a supplementary angle of the interior angle $\theta_2$ of the press-formed product, which is represented by Formula (B) below:

$$A_1=180-\theta_1 \quad (A)$$

$$A_2=180-\theta_2 \quad (B).$$

2. The production method for producing a press-formed product according to claim 1, wherein:

the bending radius $R_1$ and the interior angle $\theta_1$ of the intermediate formed product and the bending radius $R_2$ and the interior angle $\theta_2$ of the press-formed product satisfy conditions of Formulae (4) and (5) below in place of Formulae (2) and (3):

$$1.5<R_1/R_2 \quad (4)$$

$$A_1/A_2<3.5/(R_1/R_2) \quad (5).$$

3. The production method for producing a press-formed product according to claim 1, wherein:

in the first forming step, a punch and a die are used as the first die assembly, and in the second forming step, a punch and a die are used as the second die assembly.

4. The production method for producing a press-formed product according to claim 3, wherein:

in the second forming step, when performing press working, the intermediate formed product is restrained and positioned by a die pad provided in the die and an inner pad provided in the punch.

* * * * *